US005233955A

United States Patent [19]

Kraemer et al.

[11] Patent Number: 5,233,955

[45] Date of Patent: Aug. 10, 1993

[54] FUEL INJECTION PUMP FOR INTERNAL COMBUSTION ENGINES

[75] Inventors: Manfred Kraemer, Schwieberdingen; Josef Guentert, Gerlingen, both of Fed. Rep. of Germany

[73] Assignee: Robert Bosch GmbH, Stuttgart, Fed. Rep. of Germany

[21] Appl. No.: 974,633

[22] Filed: Nov. 12, 1992

[30] Foreign Application Priority Data

Nov. 12, 1991 [DE] Fed. Rep. of Germany ..... 4137072

[51] Int. Cl.[5] ..... F02B 3/00

[52] U.S. Cl. ..... 123/299; 123/500; 123/503

[58] Field of Search ..... 123/299, 300, 500, 501, 123/503

[56] References Cited

U.S. PATENT DOCUMENTS

| | | | |
|---|---|---|---|
| 4,426,198 | 1/1984 | Bastenhof et al. | 123/299 |
| 4,476,835 | 10/1984 | Laufer | 123/503 |
| 4,649,883 | 3/1987 | Böhringer et al. | 123/503 |
| 4,696,271 | 9/1987 | LeBlanc | 123/500 |
| 4,711,221 | 12/1987 | Laufer | 123/503 |
| 4,763,631 | 8/1988 | Fehlmann et al. | 123/503 |
| 4,831,988 | 5/1989 | Hoefken et al. | 123/501 |
| 4,870,936 | 10/1989 | Eheim et al. | 123/503 |
| 5,097,812 | 3/1992 | Augustin | 123/500 |
| 5,168,847 | 12/1992 | Grieshaber et al. | 123/299 |

FOREIGN PATENT DOCUMENTS

| | | | |
|---|---|---|---|
| 0222967 | 12/1983 | Japan | 123/503 |
| 1027426 | 7/1983 | U.S.S.R. | 123/503 |
| 2058947 | 4/1981 | United Kingdom | 123/503 |

*Primary Examiner*—E. Rollins Cross
*Assistant Examiner*—Thomas N. Moulis
*Attorney, Agent, or Firm*—Edwin E. Greigg; Ronald E. Greigg

[57] ABSTRACT

A fuel injection pump for internal combustion engines, having a pump piston that reciprocates in a cylinder liner inserted into a pump housing. The pump piston and housing encloses a pump work chamber, and the pump piston has a control recess on its jacket face that communicates with the pump work chamber through a conduit. An oblique groove extends at a predetermined angle from the axis of the pump piston in the jacket face thereof and forms control edges. An annular slide is axially displaceable on the pump piston and includes two diametrically opposed diversion bores. To interrupt the high-pressure pumping to provide a pre-injection quantity and a main-injection quantity, first, second and third pockets are additionally machined into the jacket face of the pump piston. These pockets cooperated with pockets machined in the annular slide and with the control edge formed by the lower face edge of the annular slide to control the fuel flow.

16 Claims, 2 Drawing Sheets

FUEL INJECTION PUMP FOR INTERNAL COMBUSTION ENGINES

BACKGROUND OF THE INVENTION

The invention is based on a fuel injection pump for internal combustion engines.

In a fuel injection pump of this type, known from Japanese Patent Application 261 667/87, the fuel injection quantity is split during the high-pressure pumping into a pre-injection quantity and a main injection quantity. This provision enables reducing the prestorage of uncombusted fuel during the ignition delay, and accordingly, overly high pressure peaks in the combustion chamber upon sudden combustion of the prestored fuel can be avoided, which in turn lessens the thermal and mechanical strain on the engine and provides noise abatement. To that end, in the known pump, besides the diversion bores in the annular slide that control the high-pressure pumping and the control recesses, and the transverse and longitudinal bores in the pump piston that connect the control recesses to the pump work chamber formed in the cylinder liner by the pump piston, a first exemplary embodiment also has a pocket in the inner wall of the annular slide, and the pocket cooperates with a transverse bore in the pump piston that discharges into the longitudinal bore.

In a second embodiment of this known fuel injection pump, during the crossover of the additional transverse bore in the pump piston that discharges into the longitudinal bore the pocket in the annular slide is additionally made to communicate with a pocket likewise made in the pump cylinder, via an additional connecting conduit disposed in the pump piston. In the high-pressure pumping of the pump piston, which begins when the control recesses on the pump piston plunge into the annular slide and when the communication between the pump work chamber and the suction chamber surrounding the annular slide is closed off, an interruption in the pressure rise in the pump work chamber occurs, because upon the crossover of additional transverse bore communicating with the pump work chamber via the longitudinal bore, fuel compressed in the pump piston flows out of the pump chamber into the pocket disposed in the annular slide, causing the pressure in the pump work chamber to drop. This pressure drop persists until a pressure equilibrium has been established between the fuel flowing into the pocket and the fuel located in the pump work chamber. From that moment on, the fuel pressure in the pump work chamber increases again, and the pumping of the main injection quantity takes place, which ends when the control recesses on the pump piston are opened as a result of the crossover of the diversion bores in the annular side. High-pressure fuel pumping is accordingly interrupted by the opening of the additional filling volume and the attendant pressure drop, and in the variant embodiment described as a second embodiment, this interruption is greater because of the larger volume to be filled. During the intake stroke of the pump piston that follows the pumping stoke, the additional pockets, which are at high fuel pressure, are pressure-relieved again via communication with the pump suction chamber.

Since storage takes place during this known type of interruption of the high-pressure pumping, the pressure in the pump work chamber does not drop far enough that the injection valves connected to it via an injection line will close and the injection will be fully interrupted.

The known fuel injection pump also has the disadvantage that the connecting conduit in the pump piston, between the pocket in the annular slide and the pocket in the pump cylinder, can be produced only with a major effort and at a great expense.

OBJECT AND SUMMARY OF THE INVENTION

The fuel injection pump according to the invention has the advantage over the prior art that, by means of a transitory relief of the high pressure in the pump work chamber resulting from the opening of communication between the pump work chamber and the pump low-pressure chamber, the pressure in the pump work chamber and in the injection line drops enough that the injection valve closes and the high-pressure pumping is interrupted.

This has the advantage that the fuel already injected into the engine combustion chamber is prepared and ignited, without being hindered by further incoming fuel, and the ignition of this small fuel quantity produces only a small pressure rise. The fuel then injected during further high-pressure pumping can also be ignited without delay from the already-ignited fuel, and it burns evenly. In addition, accurate control at little production expense or effort is possible by the provision of the control edges on the pump piston that control the supply onset and the interval between the preinjection and the main injection. Since in addition, in the exemplary embodiment described in FIG. 2, only the lower horizontal edge of the pocket made in the annular slide is needed for control purposes, the demand for accuracy in the production of this pocket is not hard to meet.

Another advantage of the invention is attained by the horizontal embodiment of the control edges, because pre-pumping and after-pumping effects are maximally precluded by this provision. With the fuel injection pump according to the invention, the demand for a constant pre-injection quantity over the entire rpm range can thus be readily met, which is still further reinforced by shifting the injection onset by means of the annular slide.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
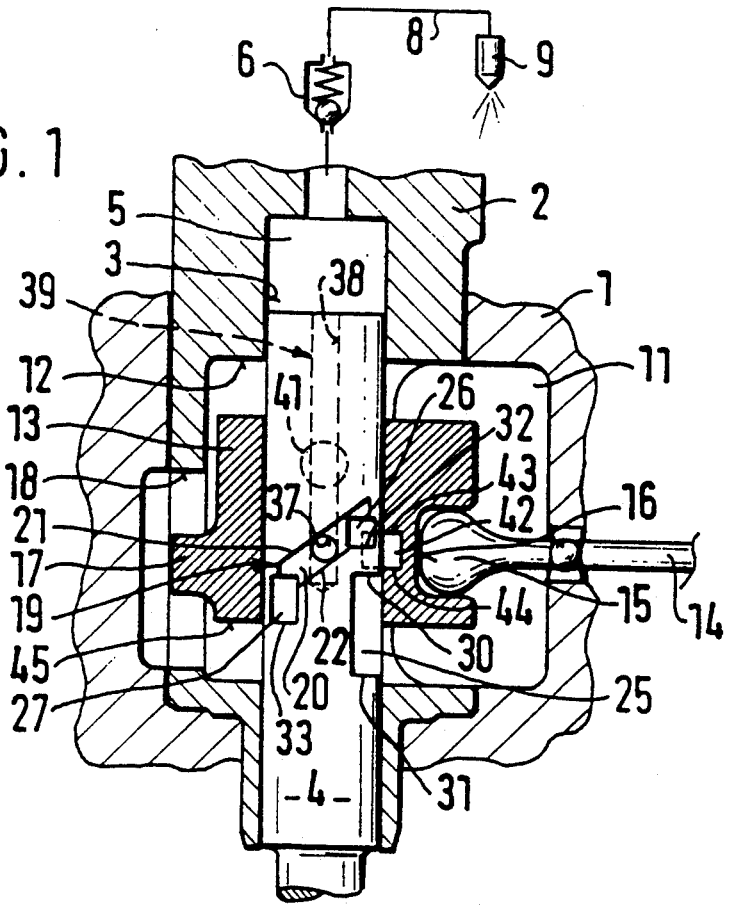
FIG. 1 is a longitudinal section through the portion of the fuel injection pump essential to the invention.

In the fuel injection pump, of which only the region essential to the invention is shown in FIG. 1, a plurality of cylinder liners 2 are inserted in an aligned row in a housing 1; each has a cylinder bore 3, in which a pump piston 4, which defines a pump work chamber 5 in the cylinder bore 3, is axially moved by a cam shaft, not shown. Via an injection line 8 that includes a pressure valve 6, the pump work chamber 5 communicates with an injection valve 9 that discharges into a combustion chamber of the internal combustion engine to be supplied. A recess 12 which is filled with fuel at low pressure is also provided in the cylinder liner 2 and receives an annular slide 13 that is axially displaceable on the pump piston 4. The low-pressure chamber 11 formed by the recess 12 acts both as a suction chamber for the fuel supply of the pump work chamber 5 and as a relief chamber during the diversion process. The annular slide 13 may be axially adjusted by a lever 14 supported on the housing, in order to vary the instant of supply onset; to that end, this lever 14 has a spherical head 15 which engages a groove 16 of the annular slide 13, and the annular slide 13 is guided, via a rib 17 radially protruding from the side remote from the groove 16, in a longitudinal groove 18 of the cylinder liner 2 and is thus secured against twisting. This longitudinal groove 18 additionally provides communication between the low-pressure chamber 11, formed by the recess 12, and the fuel supply chamber, not shown in detail here.

Two oblique grooves 19, as control recesses (in the drawing, only the control recess machined in one side visible), are machined axially symmetrically onto the jacket face of the pump piston 4, which is rotatable by a governor rod, not shown; these oblique grooves extend at a predetermined angle to the longitudinal axis of the pump piston 4, and they form not only a flat bottom 20 but also, with their lateral boundary faces, two parallel-extending control edges 21, 22 each, of which the upper control edge 21 is closer to the pump work chamber 5 and the lower control edge 22 is farther away from the pump work chamber 5.

Figure 4:
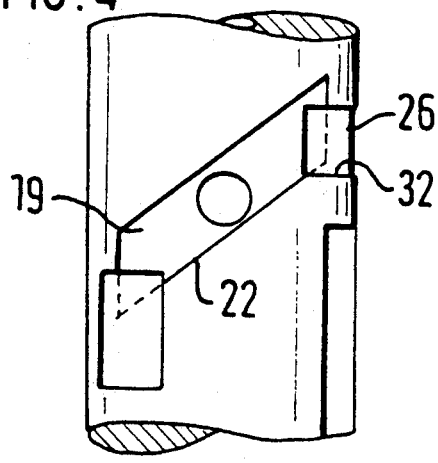
FIGS. 4 and 4*a*, in a view similar to FIG. 3, show a second variant embodiment, in which the control opening, discharging into the lower edge of the upper outlet of the oblique control groove, has the form of a rectangular pocket.

In addition, a first, vertically disposed, rectangular pocket 25 is machined onto the jacket face of the pump piston 4, below the upper outlet of the oblique groove 19 and spaced apart by a predetermined distance from the oblique groove 19; its upper end forms a first upper horizontal control edge 30, and its lower end forms a first lower horizontal control edge 31. At their upper outlet, adjacent to the lower control edge 22, the oblique grooves 19 have a control opening, which in the exemplary embodiment shown in FIGS. 1, 2 and 4 is embodied as a rectangular second pocket 26 located upstream of the oblique grooves 19, toward the pump piston drive side, and its vertical end remote from the pump piston 4 forms a second lower horizontal control edge 32 A third pocket 27 is machined into the pump piston 4, adjoining the lower control edge 22 at the lower outlet of the oblique groove 19, and the upper end of the third pocket 27 discharges into the oblique groove 19, while the lower end of the third pocket 27, toward the pump drive, forms a third lower horizontal control edge 33.

A transverse bore 37 passes radially through the pump piston 4 in the middle of the bottom 20 of the oblique grooves 19, and a blind bore 38 that begins at the pump work chamber 5 and extends axially in the pump piston 4 discharges into the transverse bore 37. The transverse bore 37 and the blind bore 38 form a conduit 39 between the oblique groove 19 and the pump work chamber 5. Two coaxial, diametrically opposed radial diversion bores 41 are disposed in the annular slide 13; they cooperate with the upper control edge 21 of the oblique groove 19 in order to determine the injection quantity, and in particular to control the end of supply during the supply stroke. The two diametrically opposed diversion bores 41 and the two oblique grooves 19 then form a so-called dual-flow control, with two diversion paths opened simultaneously by the annular slide 13. Two annular slide pockets 42 are machined into the inner wall of the annular slide 13, located below and in the middle between the diversion bores 41; the vertical ends of these pockets 42 are likewise embodied as horizontal control edges, and the upper control edge 43, closer to the pump work chamber 5, cooperates with the lower control edge 32 of the second pocket 26 that discharges into the upper outlet of the oblique groove 19. The lower control edge 44, farther from the pump work chamber 5, of the annular slide pocket 42 in the annular slide 13 cooperates during the supply stroke with the upper control edge 30 of the first pocket 25 on the pump piston 4. A further control edge 45 is formed by the lower horizontal end edge of the annular slide 13 remote from the pump work chamber 5, which cooperates with the lower control edge 33 of the pocket 2 disposed at the lower outlet of the oblique groove 19.

Figure 2:
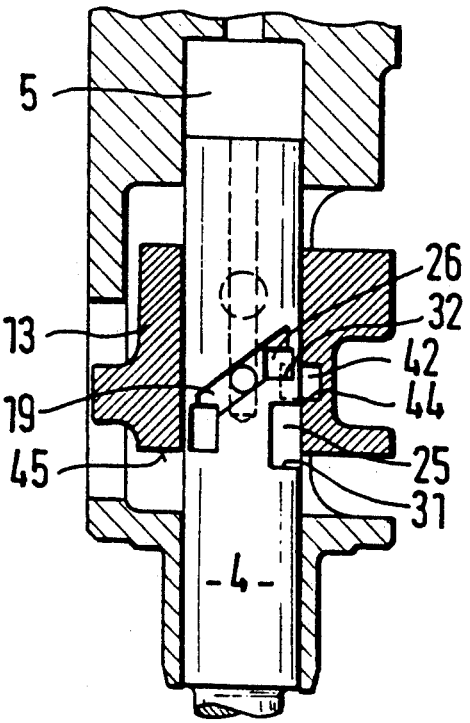
FIG. 2 is the same view as in FIG. 1, except that the axial length of the pocket additionally disposed on the pump piston is reduced.

The exemplary embodiment shown in FIG. 2 differs structurally from that of FIG. 1 only in the axial length of the pocket 25 additionally disposed on the pump piston 4.

Figure 3:
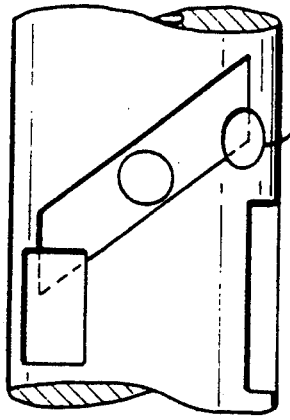
FIGS. 3 and 3*a* show a first variant embodiment of the pump piston according to the invention and its developed view, in which the control opening, disposed on the lower edge of the upper outlet of the oblique control groove, is embodied as a blind bore.
Figure 3A:
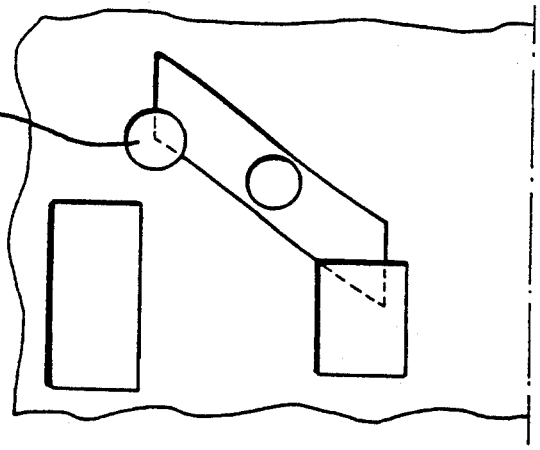
Figure 4A:
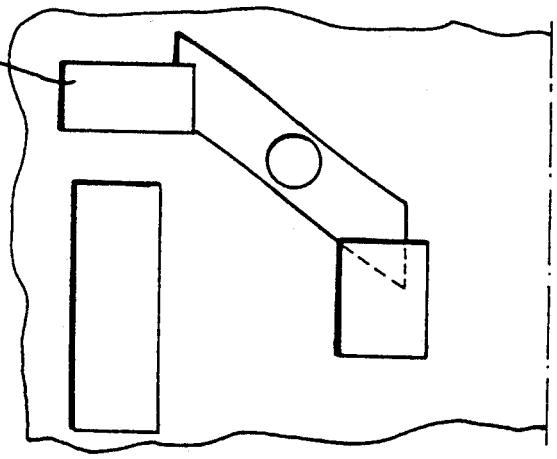
Figure 5:
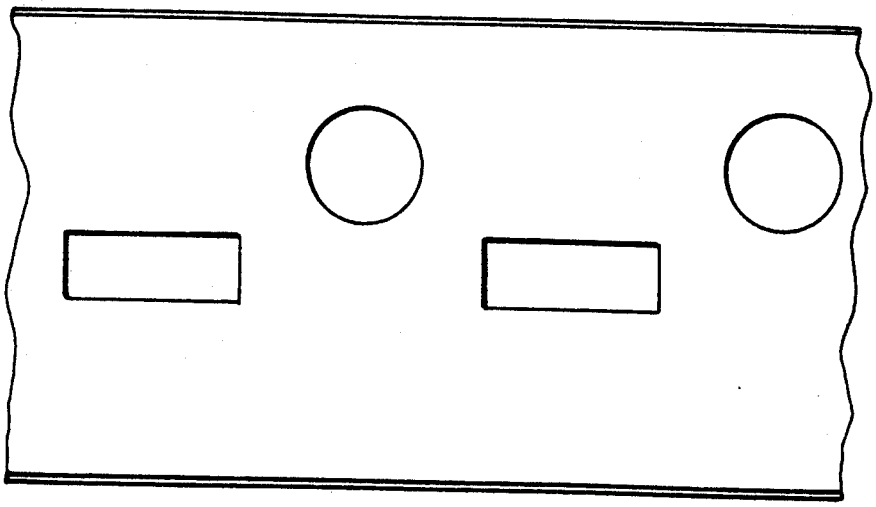
FIG. 5 is a developed view of the inner wall surface of the annular slide according to the invention, showing the pockets according to the invention.

FIGS. 3 and 3*a* show a further exemplary embodiment, analogous to the pump piston 4 shown in FIG. 1, in which the second control opening, that discharges into the outlet of the oblique groove 19 is embodied as a blind bore 50, which simplifies manufacture while preserving full functional capability. FIG. 3*a*, as in FIG. 4*a*, which shows the pump piston 4 already described in conjunction with FIG. 1, shows not only the enlarged view of the pump piston 4 of the invention but also a developed view of the pump piston surface, in order to clearly show the location of the described control edges. FIG. 5 analogously shows a developed view of the inner wall surface of the annular slide 13; compared with the developed views of the pump piston of FIGS. 3*a* and 5*a*, which show only half the developed surface of the dual-flow pump piston 4, FIG. 5 shows the entire surface.

The operation of the fuel injection pump embodied according to the invention and shown in FIG. 1 is as follows:

Once the pump piston 4 assumes its bottom dead center position, the pocket 27 that discharges into the lower outlet of the oblique groove 19 and part of the oblique groove 19 are opened by the annular slide 13 toward the low-pressure chamber 11, so that at this cross section fuel can flow virtually unthrottled into the pump work chamber 5, via the conduit 39 formed by the transverse bore 37 and the blind bore 38. Once the supply stroke of the pump piston 4 begins, the annular groove 19 and then the pocket 27 discharging into it plunge into the annular slide 13, depending upon the axial position of the annular slide 13. With the closure of the pocket 27 and the attendant closing of the conduit 39 connecting the pump work chamber 5 and the low-pressure chamber 11, by means of the crossover of the lower control edge 33 of the pocket 27 past the lower control edge 45 of the annular slide 13, the high-pressure pumping of the pre-injection quantity begins. The fuel located in the pump work chamber 5 is compressed, opens the pressure valve 6, and flows in a known manner via the injection line 8 to the injection valve 9, by which the fuel is injected into the combustion chamber of the engine to be supplied.

As the supply stroke of the pump piston 4 continues, during which an overlap between the pocket 42 disposed in the annular slide 13 and the pocket 26 discharging into the upper outlet of the oblique groove 19 has taken place, the additionally provided pocket 25 on the pump piston 4 and the annular slide pocket 42 overlap, and at that moment, via the other pocket 26, the oblique groove 19 and the conduit 39, the pocket 42 communicates with the pump work chamber 5 which is under high fuel pressure.

By the crossover of the upper control edge 30 of the first pocket 25 across the lower control edge 44 of the annular slide pocket 42 in the annular slide 13, an inflow of the compressed fuel into the first pocket 25 of the pump piston 4 takes place, the lower end of which pocket, forming the control edge 31, has not yet plunged into the annular slide 13, so that the fuel, which is at high pressure, flows out of the pump work chamber 5 into the low-pressure chamber 11 formed by the recess 12, via the conduit 39, the oblique groove 19, the second pocket 26 discharging into it, the annular slide pocket 42, and the first pocket 25 in the pump piston 4 which produces a sudden fuel pressure drop in the chamber 5. This sudden pressure drop in the pump work chamber 5 effects a rapid closure of the pressure valve 6 and injection valve 9, thereby interrupting the high-pressure fuel pumping.

As the supply stroke of the pump piston 4 continues further, the second pocket 26, disposed at the upper outlet of the oblique groove 19, re-emerges from its overlap with the annular slide pocket 42. As the lower control edge 32 of the second pocket 26 crosses over the upper control edge 43 of the annular slide pocket 42, a renewed interruption of the communication between the pump work chamber 5 and the partial suction chamber occurs, so that upon a further piston supply stroke, a high fuel pressure builds up again in the pump work chamber 5, and the high-pressure pumping and injection are continued as already described. The end of this main injection is then effected in a known manner by a crossover of the upper control edge 21 of the oblique groove 19 across the lower edge of the diversion bore 41 in the annular slide 13; the instant of diversion, and hence the fuel supply quantity, can be regulated via the rotary position of the pump piston 4 and the associated position of the oblique groove 19.

The mode of operation of the variant embodiment shown in FIG. 2 differs from that of FIG. 1 only in the manner of control of the supply onset for the main injection quantity. Here, the second pocket 26 disposed at the upper outlet of the oblique groove 19 does not emerge from the overlap with the annular slide pocket 42, so that the communication between the pump work chamber 5 and the first pocket 25 that causes the end of supply of the pre-injection is preserved. The beginning of the m in injection is then controlled by the plunging of the piston pocket 25 into the annular slide 13, and the high-pressure pumping begins exactly at the moment when the lower control edge 31 of the first pocket 25 crosses over the lower horizontal control edge 45 of the annular slide 13.

Once again, the control of the end of high-pressure pumping for the main injection takes place in the manner described for FIG. 1. The variant embodiment shown in FIG. 2 has the advantage, over the variants shown in FIG. 1, that only the lower control edge 44 of the annular slide pocket 42 is needed to control the injection process, which means that less production accuracy is needed for the annular slide pocket 42. This also makes it possible to embody the control opening, disposed at the upper outlet of the oblique groove 19, as a blind bore 50 as shown in FIG. 3, since a horizontal control edge can be dispensed with here, and the blind bore 50 need merely be embodied so as to assure a continuous intersection with the annular slide pocket 42 during the possible high-pressure supply stroke.

A further advantage of the fuel injection pump according to the invention is the capability of varying the period of time between the supply onset of pre-injection and the onset of the main injection as a function of rpm, by displacing the annular slide and thereby causing a different cam region of the cam drive driving the pump piston to become operative; various control times are also possible, by way of various cam shapes.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, having at least one pump piston (4), which is driven to reciprocate by a cam drive along an axis, a pump work chamber (5) defined by said pump piston in a cylinder bore (3) of a cylinder liner (2) inserted into a housing (1) of the fuel injection pump, at least one control recess on a jacket face of said piston, said recess communicates with the pump work chamber (5) through a conduit (39) and has an oblique groove (19) that forms an upper control edge (21) and a lower control edge (22) and extends in the piston jacket at a predetermined angle from the axis of the pump piston (4), an annular slide (13), which is axially displaceable on the pump piston (4) inside a low-pressure chamber (11), said annular slide (13) includes an inner wall face having an annular slide pocket (42) that communicates during part of the supply stroke with the pump work chamber (5) via the conduit (39), said annular slide pocket includes horizontal control edges (43, 44) and a radial diversion bore (41) that penetrates the wall of the annular slide and is associated with the oblique groove (19), which diversion bore is opened in the course of the pump piston stroke by the upper control edge (21), said pump piston (4) has a first pocket (25) on a jacket face with vertical limiting edges, whose upper and lower end each form a horizontal control edge (30, 31), which connects the annular slide pocket (42) with the low-pressure chamber surrounding the annular slide (13) during part of the supply stroke.

2. A fuel injection pump as defined by claim 1, in which the oblique groove (19) of the pump piston (4) has an enlargement of the recess on the upper end of the lower control edge (22) in the form of a blind bore (50), that cooperates with the annular slide pocket (42) disposed in the annular slide (13).

3. A fuel injection pump as defined in claim 2, in which the lower control edge (22) further includes another pocket (27) on the lower end of the oblique groove (19), located forward of the oblique groove (19) toward the drive side, said another pocket discharges into the oblique groove (19) and cooperates with a control edge (45) formed from the lower face end of the annular slide (13 , the another pocket being located on the jacket face of the pump piston (4) with a vertical end remote from the pump work chamber (5) being embodied as a horizontal control edge (33).

4. A fuel injection pump as defined by claim 3, in which a supply onset for the main injection is initiated by an emergence of a second pocket (26, 50), disposed at the upper end of the oblique groove (19), from the overlap with the annular slide pocket (42).

5. A fuel injection pump as defined by claim 2, in which a supply onset for the main injection is initiated by an emergence of a second pocket (26), 50), disposed at the upper end of the oblique groove (19), from the overlap with the annular slide pocket (42).

6. A fuel injection pump as defined by claim 2, in which a supply onset for the main injection is initiated by a closure of the vertical first pocket (25), disposed on the pump piston (4), by the lower control edge (45) of the annular slide (13).

7. A fuel injection pump as defined by claim 1, in which the oblique groove 19 has an enlargement of the recess on the upper end of the lower control edge (22) in the form of a second rectangular pocket (26) that cooperates with the annular slide pocket (42), the enlargement having a lower horizontal control edge (32) remote from the pump work chamber and an upper horizontal edge toward the pump work chamber.

8. A fuel injection pump as defined in claim 7, in which the lower control edge (22) has a third pocket (27) on the lower end of the oblique groove (19), located forward of the oblique groove (19) toward the drive side, said third pocket discharges into the oblique groove (19) and cooperates with a control edge (45) formed from the lower face end of the annular slide (13), the third pocket being located on the jacket face of the pump piston (4) with a vertical end remote from the pump work chamber (5) being embodied as a horizontal control edge (33).

9. A fuel injection pump as defined in claim 8, in which a supply onset for the main injection is initiated by an emergence of a second pocket (26, 50), disposed at the upper end of the oblique groove (19), from the overlap with the annular slide pocket (42).

10. A fuel injection pump as defined by claim 7, in which a supply onset for the main injection is initiated by an emergence of a second pocket (26, 50), disposed at the upper end of the oblique groove (19), from the overlap with the annular slide pocket (42).

11. A fuel injection pump as defined by claim 7, in which a supply onset for the main injection is initiated by a closure of the vertical first pocket (25), disposed on the pump piston (4), by the lower control edge (45) of the annular slide (13).

12. A fuel injection pump as defined in claim 1, in which the lower control edge (22) further includes another pocket (27) on the lower end of the oblique groove (19), located forward of the oblique groove (19) toward the drive side, said another pocket discharges into the oblique groove (19) and cooperates with a control edge (45) formed from the lower face end of the annular slide (13), the another pocket being located on the jacket face of the pump piston (4) with a vertical end remote from the pump work chamber (5) being embodied as a horizontal control edge (33).

13. A fuel injection pump as defined by claim 12, in which a supply onset for the main injection is initiated by an emergence of a second pocket (26, 50), disposed at the upper end of the oblique groove (19), from the overlap with the annular slide pocket (42).

14. A fuel injection pump as defined by claim 12, in which a supply onset for the main injection is initiated by a closure of the vertical first pocket (25), disposed on the pump piston (4), by the lower control edge (45) of the annular slide (13).

15. A fuel injection pump as defined by claim 1, in which a supply onset for the main injection is initiated by an emergence of a second pocket (26, 50), disposed at the upper end of the oblique groove (19), from the overlap with the annular slide pocket (42).

16. A fuel injection pump as defined by claim 1, in which a supply onset for the main injection is initiated by a closure of the vertical first pocket (25), disposed on the pump piston (4), by the lower control edge (45) of the annular slide (13).

* * * * *